US005203878A

United States Patent [19]

Woomer et al.

[11] Patent Number: 5,203,878

[45] Date of Patent: Apr. 20, 1993

[54] FUEL OIL ADDITIVES

[76] Inventors: Benjamin E. Woomer, 1597 E. 30th St., Cleveland, Ohio 44114; Lin H. Yen; Chu K. Sing, both of 42-44 Ko Shing Street, Hong Kong, Hong Kong

[21] Appl. No.: 875,084

[22] Filed: Apr. 27, 1992

[51] Int. Cl.[5] ..... C10L 1/18

[52] U.S. Cl. ..... 44/369; 44/385; 44/437; 44/628

[58] Field of Search ..... 44/308, 385, 437, 628, 44/369

[56] References Cited

U.S. PATENT DOCUMENTS 1,891,181 12/1932 Richman ..... 44/308
1,930,248 10/1933 Morrell ..... 44/437
3,647,378 3/1972 Malec et al. ..... 44/385
3,925,031 12/1975 Villacampa ..... 44/437

*Primary Examiner*—Jacqueline Howard
*Attorney, Agent, or Firm*—D. Peter Hochberg; Mark Kusner

[57] ABSTRACT

A fuel oil additive is prepared by combining a mixture of diesel oil and camphor, with a mixture of petroleum oil and benzoic acid. Additional diesel oil and turpentine are added to the combination to form one component of the additive. Such component is combined with a second component comprising a combination of Turkey red oil and water to form the additive. The additive is subsequently combined with the fuel oil to be burned and water from a combustible product. Preferably, the product is aged before burning.

14 Claims, 1 Drawing Sheet

FUEL OIL ADDITIVES

TECHNICAL FIELD

This invention relates to oil additive compositions. More particularly, this invention relates to compositions useful for addition to oils, and oil residues, which facilitate the burning thereof. Specifically, this invention relates to additives intended for incorporation in liquid hydrocarbon fuels, and fuel residues, which additives decrease pollutants produced by the burning thereof, and which increase the useful energy obtainable therefrom.

BACKGROUND OF THE INVENTION

Fuel oils can be divided into two primary classifications, i.e., distillate fuel oils, and residual fuel oils. Distillate oils are composed entirely of material vaporized in refinery distillation towers; consequently, they are clean and free of sediments, relatively low in viscosity, and they contain no inorganic ash.

Residual fuel oils, however, contain fractions that cannot readily be vaporized by heating. These fractions are black and viscous, and they include any organic ash components originally present in the crude. In some cases, the whole crude itself is used as a residual fuel.

Distillate fuel oils, being low in sulfur, free of ash, and relatively easy to handle, are used in applications where such qualities are more important than fuel prices, for example, in home heating. However, where cost is an important consideration, and large volumes of fuel are required, for instance, in electric power generation, in producing industrial steam, for process heating and the like, residual oils are usually employed as the fuels of choice.

As indicated, not all of the residual oil can be vaporized even after vigorous heating; consequently a relatively large amount of unburned residue is accumulated during the burning process. Such material collects wherever the burning takes place, for example, at the bottom of boilers, in kilns, etc., causing problems including corrosion and other unwanted chemical reactions. Furthermore, in the case of direct-fired equipment, such accumulations interfere with heat transfer, leading to wasted energy, as well as causing extended down-time as a result of the need to more frequently take the equipment off-line for cleaning and turnaround. In addition to the costs entailed in reduced operating time, such maintenance is hard on the equipment and frequently causes added wear and tear thereto.

Even before the residual oil is burned, however, deposits therefrom tend to accumulate in fuel lines and in fuel storage tanks, causing cleaning problems. In any event, the fuel value represented by the inability to conveniently burn such deposits amounts to a significant energy loss over time.

Beyond the preceding disadvantages, however, and due to the incomplete combustion of the residual oil components, the burning process results in the formation and release to the environment of undesirable amounts of pollutants such as smoke, carbon monoxide and sulfur compounds, all of which have a detrimental affect on the atmosphere, and such release in many instances is contrary to law.

BRIEF DESCRIPTION OF THE INVENTION

In view of the preceding, therefore, it is a first object of this invention to provide additives for liquid hydrocarbon fuels, including particularly residual fuel oil.

A second object of this invention is to provide additives for fuel oil that facilitate the burning thereof.

Another object of this invention is to provide additives for fuel oils that reduce the amount of pollutants generated by the oils during the burning process.

An additional object of this invention is to provide additives for fuel oils that assist in the solution and blending of otherwise insoluble residues contained in fuel oils.

A further object of this invention is to provide additives for fuel oils that make it possible to produce more energy during the process of burning the oils.

A still additional object of this invention is to provide additives for fuel oils that improve the heat transfer characteristics of equipment in which such oils are burned.

Yet a further object of this invention is to provide additives for fuel oils that reduce the amount of effort involved in maintaining fuel oil-related equipment in good operating order.

The foregoing and additional objects of the invention are provided by additives for liquid hydrocarbon fuels. The additives contemplated are prepared by blending a mixture of diesel oil and camphor with a mixture containing petroleum oil and an aromatic acid. The blend is combined with additional diesel oil and with turpentine, and the resulting composition is combined with a composition comprising a mixture of Turkey red oil and water. Thereafter, the two compositions are mixed to form the desired additive.

The foregoing and other objects of this invention are provided by the process of preparing a combustible mixture comprising blending a mixture of diesel oil and camphor, with a mixture of petroleum oil and an aromatic acid. After additional diesel oil, and turpentine, have been added, the composition is combined with a composition comprising Turkey red oil and water to form an additive. The additive is thereafter combined with additional water, and a liquid hydrocarbon fuel to form the combustible mixture.

BRIEF DESCRIPTION OF THE DRAWINGS

The invention will be better understood when reference is had to the following Figures in which.

DETAILED DESCRIPTION OF THE INVENTION

The invention described hereinafter comprehends the preparation and incorporation of certain oil additives in fuel oils containing insoluble, or relatively insoluble substances in order to convert such substances into a form permitting them to be conveniently volatilized and burned as fuel.

The additives of the invention are prepared by forming a first composition comprising diesel oil and camphor, together with a second composition which includes petroleum oil and an aromatic acid. The two compositions are combined, and additional diesel oil, as well as turpentine are added to provide one component of the additive.

A second component of the additive is formed by mixing Turkey red oil with water.

The two components are subsequently combined to form the desired fuel additive.

A combustible mixture can thereafter be formed by mixing the fuel additive with the material to be burned, for example, residual fuel oil; water is also added to produce the final mixture, which is preferably allowed to stand for a period of time prior to being burned as a fuel.

While not wishing to be bound by the theory, it is believed that a primary function of the additive is to thoroughly dissolve and blend the hard-to-dissolve carbon compound residues in the fuel oil, converting them into materials which can thereafter be vaporized and burned. In the process, the density and viscosity of the fuel oil is substantially lowered, facilitating handling of the oil, as well as its burning.

The diesel oil useful for purposes of the invention, sometimes referred to as fuel oil #2, consists chiefly of unbranched paraffins and is a straight-run or cracked distillate derived from petroleum oil.

The camphor from which the additives are made is also known as gum camphor, or 2-camphanone, a ketone occurring naturally in the wood of the camphor tree *Cinnamonum Camphora.*

The turpentine used in synthesizing the additives is a volatile, essential oil whose chief constituents are pinene and diterpene. The material is obtained by the steamdistillation of turpentine gum, by the naphtha extraction of pine stumps, or from the destructive distillation of pine wood.

The Turkey red oil used in the additives is a sulfonated castor oil, readily obtainable from a variety of sources.

A variety of aromatic acids can be used in the process of the additive preparation; however, the use of benzoic acid is particularly preferred.

Figure 1A:
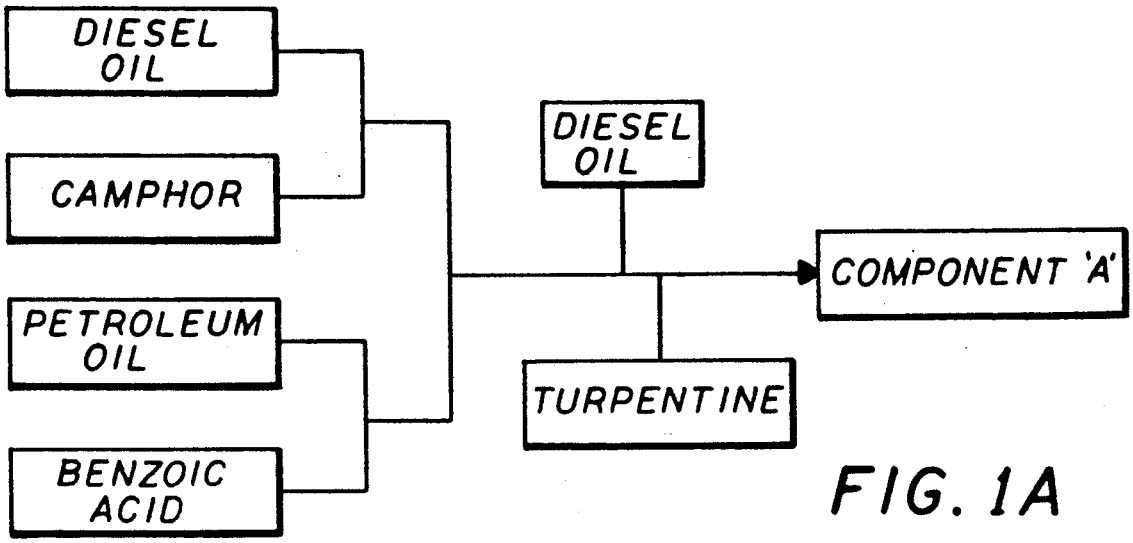
FIG. 1A is a block diagram illustrating preparation of a first component of the additive of the invention.

Referring to FIG. 1A, the block diagram illustrates the combining of the diesel oil and camphor, the latter preferably being in the form of a powder, to form a homogeneous mixture. Also shown is the blending of benzoic acid with petroleum oil to form a further, homogeneous mixture. Thereafter, the two mixtures are combined, and the combination further combined with diesel oil, the two being intimately mixed. Finally, the resultant mixture is combined with turpentine and mixed until homogenization is achieved.

Figure 1B:
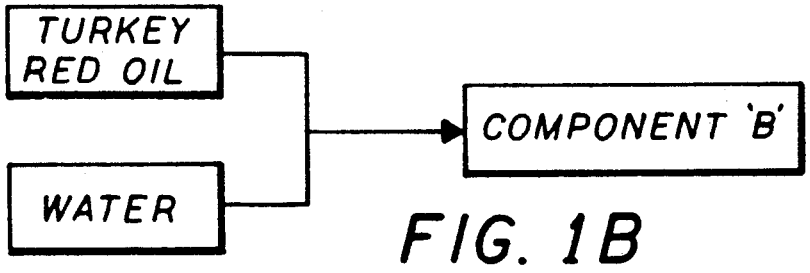
FIG. 1B is a block diagram illustrating preparation of a second component of the additive of the invention.

FIG. 1B shows the formation of the second component of the additive, prepared by the combination of Turkey red oil and water, the two being mixed until a homogeneous mixture is obtained.

Figure 1C:
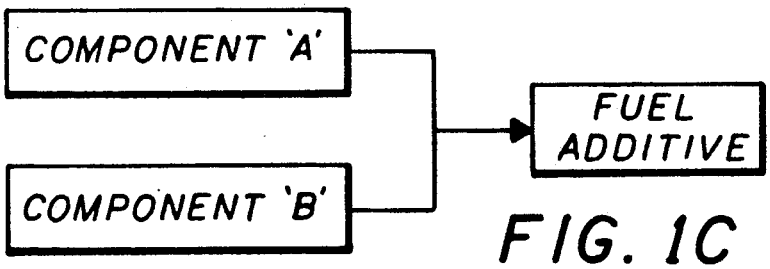
FIG. 1C is a block diagram illustrating preparation of the fuel additive from the components shown in FIGS. 1A and 1B.

The block diagram of FIG. 1C illustrates the subsequent combination of the first and second components, components A and B respectively, to provide the fuel additive.

Figure 1D:
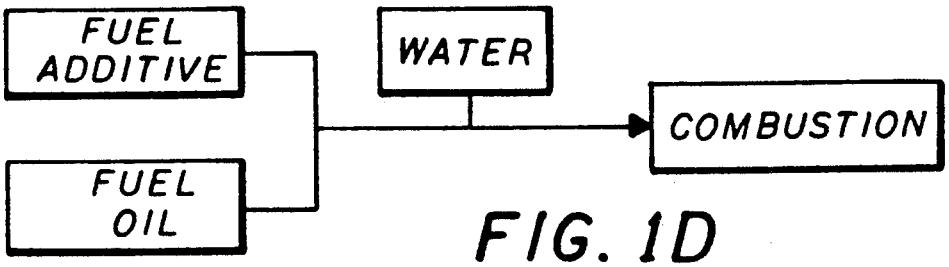
FIG. 1D is a block diagram illustrating the preparation of a combustible fuel mixture according to the invention.

Finally, FIG. 1D shows the combination of the fuel additive with a fuel oil, followed by the addition of water. After being thoroughly mixed, and preferably aged, the mixture can be efficiently burned with significantly reduced pollution.

While the additives can be used with any fuel oils, they are particularly useful with fuel oils of the type known as "residual" fuel oils. In addition, the additives can be used to advantage with other viscous hydrocarbon fuels, for instance with heavy oils and tars resulting from petroleum coking, and other processes.

In preparing the components and mixtures employed in the preparation of the additives, the ratio of the materials combined to form the same may be adjusted within relatively broad limits. In this regard, for example, while a ratio of diesel oil/camphor in the initial camphor mixture shown in FIG. 1A of about 1000 cc/500 gm is preferred, the ratio can be varied considerably, for instance, a ratio within the range of about 1000 cc/300–600 gm is also suitable.

The petroleum oil in component A of FIG. 1A will amount to about 500–600 cc for every 1000 cc of diesel oil initially combined in the diesel/camphor mixture described, and about 480–550 gm of benzoic acid will be employed with that amount of petroleum oil. However, a ratio of 500 cc/500 gm petroleum oil/benzoic acid is preferred.

The further quantity of diesel oil added to form component A as shown in FIG. 1A, will be adjusted to constitute about 2000 cc of diesel oil for every 1000 cc of diesel oil initially combined with the camphor.

The turpentine added will be adjusted to comprise from about 80–150 cc, about 100 cc being preferable, for each 1000 cc of diesel oil initially combined with the camphor.

In regard to component B, the ratio of Turkey red oil/water will conveniently be about 1000 cc/3000 cc.

Approximately equal volume amounts of component A will be combined with component B to form the fuel additive.

The ratio of additive/petroleum oil/water in the combustible mixture will typically be about 2000 cc/1 metric ton/28–33%, respectively, although the presence of about 30% of water, based on the total volume of fuel oil and additive present is preferred.

It is desirable that each of the combinations referred to be mixed to the extent necessary to achieve a substantially homogeneous combination. Any of a wide variety of mixers may be employed for this purpose including paddle mixers, propeller mixers, turbine mixers and the like.

In any case, the time required to achieve a homogeneous mixture will depend upon the type of mixer employed and the conditions under which it is operated. However, in most instances, a satisfactory mixture can be obtained in from about 10–20 minutes. Visual inspection of the mixtures will provide a suitable guide for determining when adequate mixing has been achieved.

Generally, the order of addition described in the Figures will provide preferred results, although the order can be varied somewhat if desired. In carrying out the mixing of diesel oil and the camphor powder, it is desirable to heat the oil to about 60°–75° C. in order to obtain a homogeneous mixture within the mixing time specified.

In a preferred embodiment, after its preparation, the combustible mixture of additive, fuel oil and water is allowed to rest or "age" for at least about 4 hours before it is burned. This permits the water to become fully blended with the oil. Thereafter, the mixture is very stable and in such condition, it resists decomposition or the formation of separate phases, and may be safely stored even after chilling, for example, up to at least about 150 days.

While in accordance with the patent statutes, a preferred embodiment and best mode has been presented, the scope of the invention is not limited thereto, but rather is measured by the scope of the attached claims.

What is claimed is:

1. An additive for liquid hydrocarbon fuels produced by the process of:

forming a first component by blending a composition (a) of diesel oil and camphor with a composition (b) of petroleum oil and an aromatic acid, combining said blend with additional diesel oil and with turpentine, forming a second component by combining Turkey red oil and water, and thereafter combining said first and second components to form said adhesive.

2. An additive according to claim 1 in which said aromatic acid is benzoic acid.

3. An additive according to claim 2 wherein said first component has about 300 gm to about 600 gm of camphor for about every 1000 cc of diesel oil in composition (a), and for about every 1000 cc of diesel oil in composition (a), composition (b) contains about 480 gm to about 550 gm of benzoic acid and from about 500 cc to 600 cc of petroleum oil, with about 2000 cc of additional diesel oil and about 80 cc to about 150 cc of turpentine being added to said blend for every 1000 cc of diesel oil present in composition (a);

wherein said second component contains about 1000 cc of Turkey red oil for about every 3000 cc of water present; and wherein further, said first and second components are combined in about equal volume amounts to form said additive.

4. The combustible mixture formed by combining the additive of claim 3, with additional water, and a liquid hydrocarbon fuel.

5. The mixture according to claim 4 wherein about 2000 cc of said additive is combined with about each metric ton of said liquid hydrocarbon fuel, and wherein said additional water comprises about 28% to about 33% of said additive and said fuel, on a volume basis.

6. The process of preparing a combustible mixture comprising:

combining a first component formed by blending a composition (a) of diesel oil and camphor, and a composition (b) of petroleum oil and an aromatic acid, to which blend additional diesel oil and turpentine have been added, with a second component formed by combining Turkey red oil and water, to form an additive, and thereafter combining said additive with additional water, and a liquid hydrocarbon fuel to form said combustible mixture.

7. The process of claim 6 in which said aromatic acid is benzoic acid.

8. A process according to claim 7 in which prior to combustion, said combustible mixture is allowed to age for at least four hours following its preparation.

9. A process according to claim 6 wherein said first component has about 300 gm to about 600 gm of camphor for about every 1000 cc of diesel oil in composition (a), and for about every 1000 cc of diesel oil in composition (a), composition (b) contains about 480 gm to about 550 gm of benzoic acid and about 500 cc to about 600 cc of petroleum oil, with about 2000 cc of additional diesel oil and about 80 cc to about 150 cc of turpentine being added to said blend for every 1000 cc of diesel oil present in composition (a);

wherein in said second component there is about 1000 ccc of Turkey red oil for about every 3000 cc of water present;

wherein said first and second components are combined in about equal volume amounts to form said additive; and wherein further, about 2000 cc of said additive are combined with about 1 metric tone of said liquid hydrocarbon fuel, and with about 28% to about 33% of water based on the volume of said additive and said liquid hydrocarbon fuel present.

10. A process according to claim 6 in which said liquid hydrocarbon fuel is residual fuel oil.

11. The process of burning a combustible mixture prepared by the process of claim 9.

12. An additive for liquid hydrocarbon fuels, said additive comprising a mixture of a first component and a second component;

said first component including a mixture of a first composition of (a) diesel oil and camphor, and a second composition of (b) petroleum oil and aromatic acid, (c) diesel oil and (d) turpentine; and said second component including a mixture of Turkey red oil and water.

13. An additive according to claim 12 wherein said aromatic acid is benzoic acid.

14. An additive according to claim 13 wherein said additive has in about equal parts said first component and said second component, and wherein the ingredient proportions are about as follows:

in the first component:

| | | |
|---|---|---|
| (a) | diesel fuel | 1000 cc |
| | camphor | 300 gm to 600 gm |
| (b) | petroleum oil | 500 cc to 600 cc |
| | benzoic acid | 480 gm to 550 gm; |

in the second component:

| | |
|---|---|
| Turkey red oil | 1000 cc |
| water | 3000 cc. |

* * * * *